United States Patent [19]

Stiehl et al.

[11] Patent Number: 4,878,149

[45] Date of Patent: Oct. 31, 1989

[54] DEVICE FOR GENERATING IONS IN GAS STREAMS

[75] Inventors: Hans-Henrich Stiehl; Thomas Sebald, both of Berlin, Fed. Rep. of Germany

[73] Assignee: Sorbios Verfahrenstechnische Gerate und GmbH, Berlin, Fed. Rep. of Germany

[21] Appl. No.: 138,092

[22] PCT Filed: Feb. 5, 1987

[86] PCT No.: PCT/DE87/00048

§ 371 Date: Dec. 3, 1987

§ 102(e) Date: Dec. 3, 1987

[87] PCT Pub. No.: WO87/04873

PCT Pub. Date: Aug. 13, 1987

[30] Foreign Application Priority Data

Feb. 5, 1987 [DE] Fed. Rep. of Germany ..... 3603947

[51] Int. Cl.[4] ..... H01T 23/00; H05F 3/06

[52] U.S. Cl. ..... 361/230; 361/235; 361/231

[58] Field of Search ..... 361/229, 230, 235, 213; 55/151

[56] References Cited

U.S. PATENT DOCUMENTS

| | | | |
|---|---|---|---|
| 3,711,743 | 1/1973 | Bolasny | 361/235 |
| 4,092,543 | 5/1978 | Levy | 361/213 |
| 4,210,949 | 7/1980 | Masuda | 361/235 |
| 4,542,434 | 9/1985 | Gehlke | 361/231 |
| 4,638,348 | 1/1987 | Brennecke et al. | 361/230 |
| 4,710,203 | 12/1987 | Bätza et al. | 55/151 X |

*Primary Examiner*—L. T. Hix
*Assistant Examiner*—D. Rutledge
*Attorney, Agent, or Firm*—Andrew R. Basile; William M. Hanlon, Jr.

[57] ABSTRACT

A device for generating ions in gas streams is proposed, which has an electrode arrangement exposed to the gas streams and a pulsed high voltage supply, which supplies an alternating sequence of negative and positive pulses with step edges. The electrode arrangement comprises at least one point discharge electrode and at least one counterelectrode associated with one another in fixed, clearly defined manner. The time behaviour of the high voltage signal is fixed in such a way that the duration of the particular pulse corresponds to the transit time of the ions between the electrodes and the spacing of the pulses is adapted to the speed of the gas streams.

14 Claims, 7 Drawing Sheets

FIG. 5a
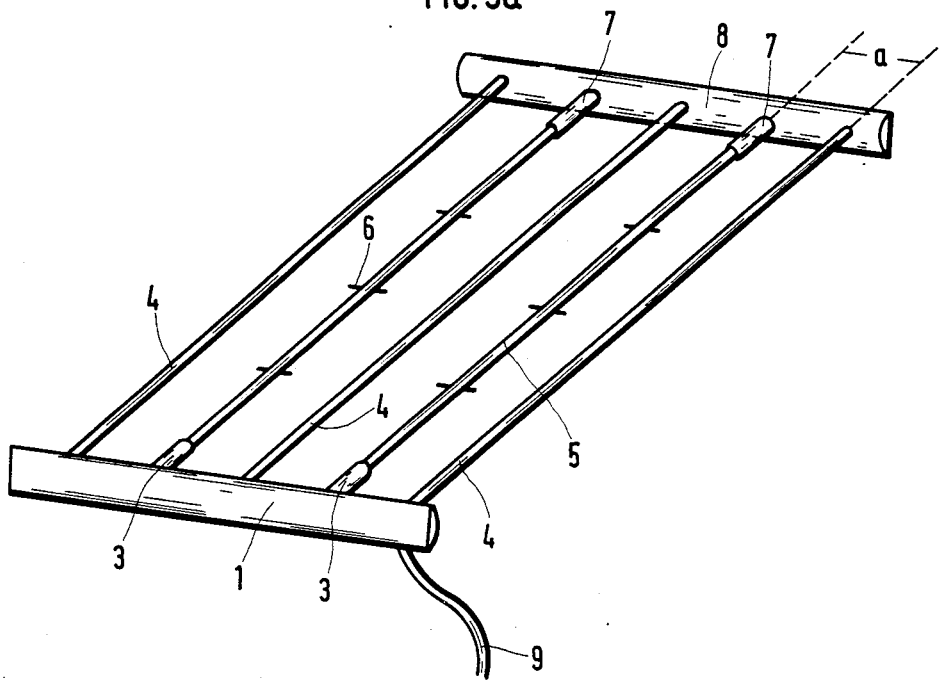
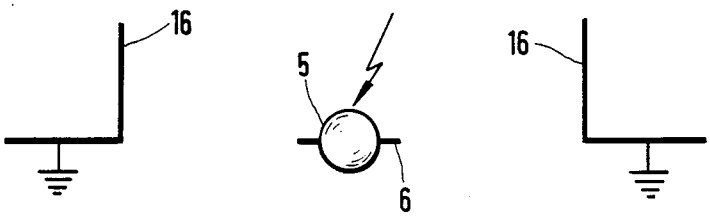
FIG. 5b
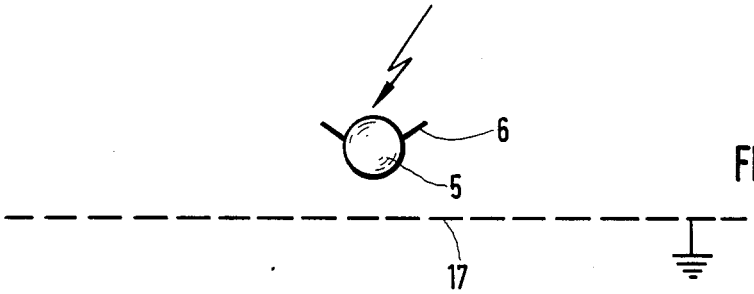
FIG. 5c

DEVICE FOR GENERATING IONS IN GAS STREAMS

BACKGROUND OF THE INVENTION

1. Field of the Invention

The invention relates to a device for generating ions in gas streams for reducing electrostatic charges which, on sensitive products, such as e.g. microchips, films, magnetic plates, laser storage plates and printed circuit boards, in the case of an uncontrolled discharge lead to destruction or increased particle deposition.

2. Background of the Invention

In the manufacture of highly integrated semi-conductor components, with laser and magnetic storage plates and with other products having microstructures in the resolution range of one micrometer and less, both particle contamination and uncontrolled, electrical discharges lead to considerable quality losses. The term microstructures here also covers sensitive plastic films or surfaces in general, in which the deposition of micro particles lead to quality losses. Electro-static charges are the cause of the damage. Such manufacturing processes, for example, take place in clean rooms, whose air is prefiltered to a very high level and flows through the clean room in a low turbulence, piston-like displacement flow. The air flowing into such clean rooms can be filtered to such a high level that virtually no particles pass via, the air flow, into the clean room. The particles produced during manufacture, largely result from the production process itself or are caused by the operating personnel. The device, according to the invention, can also be operated at restrictive work places or stations with specially produced air flow.

The charges are produced by friction, electrostatic induction, or capacitive processes and are unavoidable during the movement of the product, particularly on insulating surfaces. Charge densities can occur, which lead to voltages of several thousand volts. These charged surfaces, by means of electrostatic forces, increasingly attract aerosols, particularly charged aerosols.

In the case of surfaces charged with 500 V, there is approximately a 20X particle deposition compared with a neutral surface. However, such surface charges can be discharged in uncontrolled manner over the microstructures, which can either be destroyed by an electric breakdown or by high current densities. Sensitive metal oxide semiconductor structures on silicon chips can be destroyed by discharges of voltages of around 50 V.

The charging of insulating surfaces on the product and increased particle deposition can be prevented through the air flow containing ions having a positive and negative sign. Thus, charges are compensated both on airborne particles and on the product surfaces. There can be no uncontrolled discharges over the microstructures. Surface discharges are reduced by a controlled discharge over air ions. In the case of electrostatically sensitive products a uniform distribution of positive and negative ions is particularly important.

For generating positive and negative air ions, it is known to use the Townsend gas discharge in the non-uniform electrical field of needle points of wires. A device for generating ions on points is disclosed by U.S. Pat. No. 1,356,211, while DE-OS No. 28 09 054 describes a device for generating ions on wires. In the vicinity of the points or wire surface a discharge zone is formed with an extension of approximately 0.5 mm, in which the gas molecules are ionized. With increasing distance from the discharge zone the speed decreases as a result of the field which is becoming ever weaker. A condition which must be fulfilled for ensuring that the ions can be carried away by the air stream is that their speed is the non-uniform field drops to a value which is lower than the air speed. For igniting a gas discharge on highly curved surfaces a voltage of 6 to 7 kV is necessary. When operating such ionizers with a voltage of approximately 10 kV, the speed of the ions decreases within 50 to 100 cm to a value below 1 m/sec. The standard air flow rate at clean work stations is approximately 0.5 m/sec. It becomes clear from what has been stated hereinbefore that for the distribution of the ions in the air flow, there is a close connection between the air speed on the one hand and the time pattern of the high voltage linked with the charge electro-geometry.

Conventional ionizers operate with voltages between 10 and 20 kV. The time behavior of the voltage is either uniform (FIG. 1*c*), a signwave voltage (FIG. 1*a*) of 50 to 60 Hz or a rectangular voltage gradient (FIG. 1*c*).

It is known that for the same field geometry of the discharge and the same voltage, more ions are generated at the negative emitter than at the positive emitter. As ionizers can only fulfil their surface discharge neutralization function if the same number of positive and negative ions is introduced into the air flow, the sinusoidal a.c. voltage is disadvantageous for the supply of emitters, whereas, in the case of a rectangular voltage gradient and a d.c. voltage supply, it is possible to geneate ions with a compensated polarity balance by setting the corresponding d.c. voltage level.

The rectangular voltage gradient and the sinusoidal a.c. voltage suffer from the disadvantages that the switching of the peak polarity takes place at times which are short compared with the flow rate of the air. In this case ions introduced into the air are returned to the point through the rapid polarity change and are ineffective for air ionization, thus the efficiency of ion emission is also impaired. Efficiency is here understood to mean the ratio of the number of ions entering the air flow to the total number of ions generated at the point.

These disadvantages increase the current loading of the point electrodes. In the case of high current loading of the point electrodes, there is an increased material removal and consequently an incease of the radius at the points, as well as increased accumulation of particles at the point. Thus, ion generation decreases with the reduction of the non-homogeneous field. Therefore time-constant operating conditions are called into question. In practice, these disadvantages are corrected by increasing the operating voltage, which speeds up the described disadvantages.

Increased current loading by return transit is also not prevented in known systems, in that in each case two point groups are separately supplied with d.c. voltage. In this case the potential difference between the points is approximately 20 kV and the spacing between the points must be correspondingly large at approximately 30 cm. Consequently the average ionic velocity remains so large that only a small ion proportion from the marginal zones of the electric field is taken up by the air flow. Therefore, the same disadvantages must be expected as in the case of a.c. voltage-operated ionizers. The construction of planar ionozers, such as can, for example, be fitted in large-areas like those found under the ceiling of clean rooms, leads to a locally discontinuous ion generation. In the boundary region of ionizers supplied in this way there are excesses of one ion polarity which, contrary to the actual function of ionziers, can lead to additional charges. It is even more disadvantageous that the constant field strengths parallel to the electrode plane produced between such electrodes, supplied with d.c. voltage and fitted in the cross-sectional plane of the air flow lead, on the outflow side to the separation of negative and positive ions. Such a separation can lead to charges of several hundred volts due to the excess of ions of one polarity.

Through operational experience with ionizers in clean rooms, for example, of class 10 according to U.S. Federal Standard 209c with particularly high requirements, operational disadvantages have been found in the case of the three operating modes of ionizers described in FIG. 1. These disadvantages relate inter alia to the wearing away of the points, the introduction of metallic point material into the clean room air and to the accumulation of contaminants on the points, as well as electrochemical conversion processes of gaseous products into solid particles. According to the latest research of B. Y. Liu et al, Tex. Instr. Corp: Characterizaton of Electroinc Ionziers for Clean Rooms; IES 1985, in the clean room air there are up to an additional $1.5\times10^6$ particles per $m^3$. However, in top-quality clean rooms, particle concentrations around 300 particles per $m^3$ and less are sought.

SUMMARY OF THE INVENTION

The invention is to provide a device for generating ions in gas streams with an electrode arrangement exposed to said gas streams and a pulsed high voltage supply, which supplies an alternating sequence of negative and positive pulses with steep sides which, over a long period of time, ensures constant operating conditions with uniform ion distribution over the flow cross-section, ensuring good efficiency.

Due to the fact that the point discharge electrodes and associated counter-electrodes are provided in a fixed and clearly defined association with one another, a clearly defined electric field is made available and the time behaviour of the high voltage applied to the point discharge electrodes is correlatable with the gas velocity and ion transit time between the discharge electrodes and the counterelectrodes, so that the efficiency is increased. Through the geometrical arrangement of point discharge electrodes and counter electrodes a unifrom ion distribution is produced over the flow cross-section and the disturbing influence of other potentials in the room on ion generation and distribution is prevented. The alternation of positive and negative high voltage on the same point discharge electrode avoids constant steady fields at right angles to the gas flow direction, which would lead to a separation to the positive and negative ions.

Due to the fact that the material adopted for the point discharge electrodes, niobium, is a low-erosion electrode material, the wearing away behaviour is improved and the sputtering tendency reduced.

The inventive device can be used in both top-quality clean rooms and outside such clean rooms. In the non-highly filtered air outside clean rooms, there can be contamination of point discharge electrodes through the accumulation of particulate air contaminants, which lead to an impairing of ion generation. Thus, for cleaning purposes, the electrode support can be removed from its spring-locked plug fit by using a grip or handle and can then be reinserted after cleaning.

Through the provision of high voltage relays it is possible to galvanically separate positive and negative high voltage generators so that supply of the point discharge electrodes with positive and negative high voltage can take place via one, single-core, shielded high voltage cable. Due to the load-free switching of the high voltage relays, the life thereof is considerably increased.

Through the provision of a high voltage supply having a separate low voltage control unit and a high voltage module, the latter can be positioned in the vicinity of the electrode arrangement outside the gas stream, so that no undesired turbulence occurs in the gas stream. The low voltage control unit, which energizes the high voltage module for regulating the positive and negative ion quantities, can be located in the immediate vicinity of the work station. While the connection between the electrode arrangement and the high voltage module takes place by means of a shielded high voltage cable, the high voltage module is energized by the low voltage control unit with direct current, so that it is also possible to use considerable cable lengths without any risk of disturbing sensitive electronic control and measuring equipment in the production sphere by irradiated electromagnetic radiation.

Another advantage of the invention is that additional particle production is significantly reduced. Measurements have established that in the case of a resolution of approximately 100 particles per $m^3$, no additional particle production resulted from the inventive device.

It is known that prior art ionizers through gaseous discharge produce ozone in a concentration which can be prejudicial to the health of the working personnel. The measurements carried out during the operation of the inventive device led to no increase in the ozone concentration present in the natural ambient air, because the current intensity in the discharges on the point electrodes, with the aid of the voltage supply, is extremely low. An important criterion for operational safety and also for the loading of the points of the discharge electrodes, is the high voltage level, which in the case of known ionizers can be 30 kV. As a result of the high efficiency of ion emission and due to the homogeneous distribution of the discreet ion sources in the flow cross-section, the maximum operating voltage can be reduced to below 15 kV in the case of the invention. Despite the low operating voltage, discharge times are obtained, which satisfy the high demands made, for example, during chip manufacture.

For achieving short discharge times in the case of known ionizers, the point electrodes are directed towards the field of processing sensitive products. In this case, voltages above the sensitivity threshold of the products can be influenced. These disadvantages are largely obviated, in the case of the inventive device, through a horizontal orientation of the alternating fields in the cross-sectional plane of the air stream parallel to the working plane, as well as through the dense and clearly defined arrangement of the counterelectrode. The inventive device permits working in the immediate vicinity of the ionizer if, between the working plane and the ionizer, is fitted a metal perforated plate at ground potential. This modification does not reduce the efficiency of the ionizer.

The invention is described in greater detail hereinafter relative to the drawings, which show:

DESCRIPTION OF THE DRAWING

FIG. 5a a perspective diagrammatic representation of the electrode arrangement of a second embodiment of the present invention.

FIGS. 5b a diagrammatic sectional representation of a further electrode arrangement of the present invention and 5c a diagrammatic sectional representation of a further electrode arrangement of the present invention.

FIG. 6 a partial section through an electrode support according to FIG. 5a.

FIG. 7b a pulse diagram for the high voltage module according to FIG. 7a.

DESCRIPTION OF THE PREFERRED EMBODIMENTS

Figure 4:
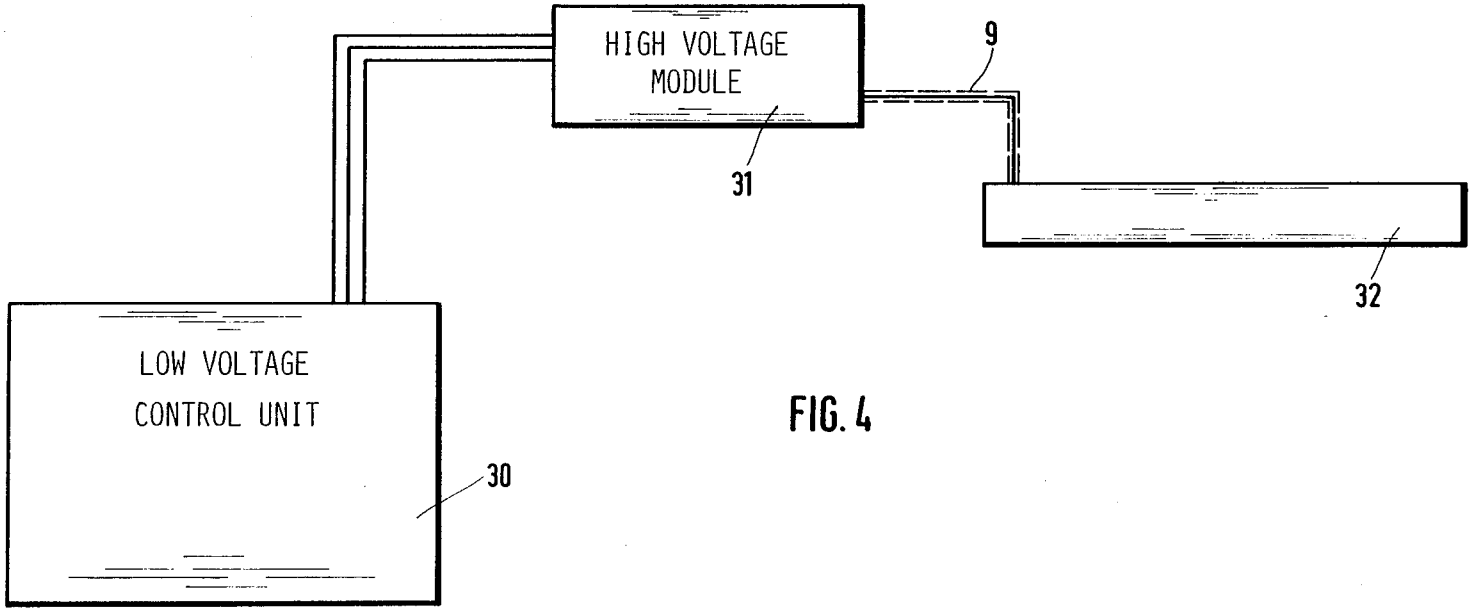
FIG. 4 is a diagrammatic representation of the different components of the present invention.

FIG. 4 shows the inventive device, which has a low voltage control unit 30, a high voltage module 31 and an electrode arrangement 32. The electrode arrangement is located in the vicinity of the air stream. In the case of clean rooms, electrodes may be placed in the ceiling area below air outlets or air filters. FIG. 5a diagrammatically shows a grid-like electrode arrangement, which is suitable for installing below a clean room filter ceiling. Electrode arrangement 32 has cross-members 1,3 made from metalic semicircular sections, which form a fixed frame with tubular, metal, grounded counterelectrodes 4. Electrode supports 5, which carry point or needle-like discharge electrodes 6 are fixed by means of plug connections or connectors 3,7 to the cross-members 1,8. Counterelectrodes 4 and electrode supports 5 are arranged parallel to one another in one plane, the point discharge electrodes also being in one plane and preferably directed at right angles to the counterelectrodes 4. In FIG. 5a, there are only three point discharge electrodes 6 per discharge support 5. Obviously more discharge electrodes can be provided. The counterelectrodes 4 and electrode supports 5 have a diameter of approximately 3 to 15 mm and the spacing between them is between 5 and 30 cm. The point discharge electrodes 6 are superimposed with uniform spacings of approximately 5 to 30 cm.

The high voltage is supplied to the discharge electrodes 6 via protective resistors in the cross-member 1 and the plug connector 3, the electrode supports 5 being connected electrically and in parallel. A clamping connection (not shown) for the electrical connection of the grounded shield of a one-core high voltage cable 9 is provided in or on the cross-member 1.

Figure 6:
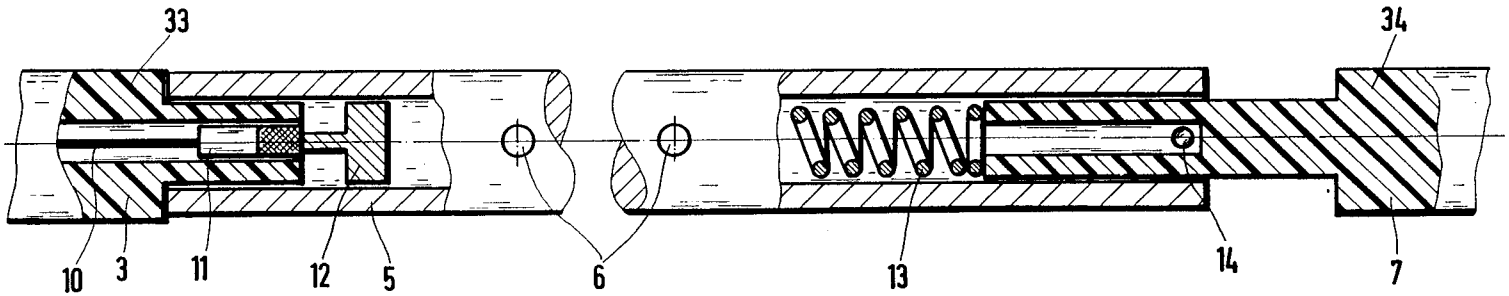

FIG. 6 is a cross-section through an electrode support and in particular plug connectors 3,7. Plug connector 3 has an acrylic tube 33 with a shoulder or lug, into whose interior is led the high voltage cable 10. The shoulder or lug is introduced into the electrode support 5; the electrical connection being formed by a bush 11 connected to the high voltage line and a pin 12 provided in electrode support 5. Acrylic tube 33 ensures a surface leakage path between the electrode support at high voltage and the cross-member 1 at ground potential. Plug connector 7 also has an insulating acrylic rod 34, whose end is inserted in the electrode support and fixed by means of a set pin 14. A compression spring 13 is supported on the end of acrylic rod 34. Set pin 14 prevents twisting, so that the point discharge electrodes cannot change their position with respect to the counterelectrodes 4. Together the plug connectors 3,7 form a spring-locked plug fit, so that the electrode supports can be removed and cleaned without great difficulty.

Figures 1A, 1B, 1C:
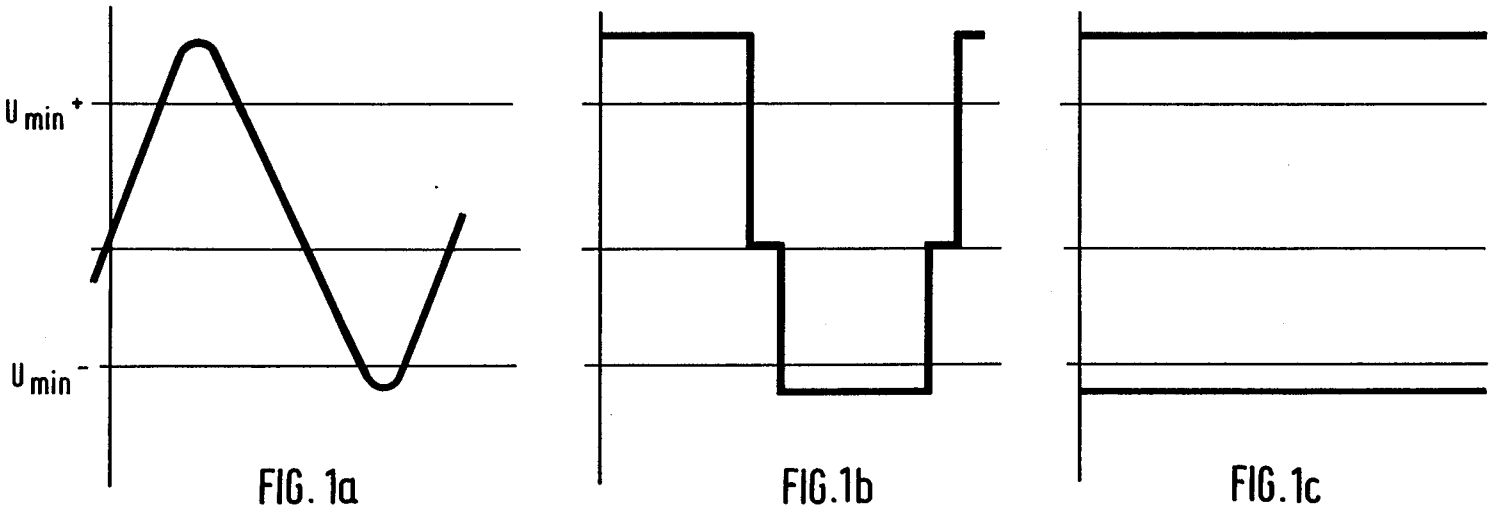
FIGS. 1a–1c different time patterns of high voltages for supplying the discharge electrodes of the present invention.
Figure 2:
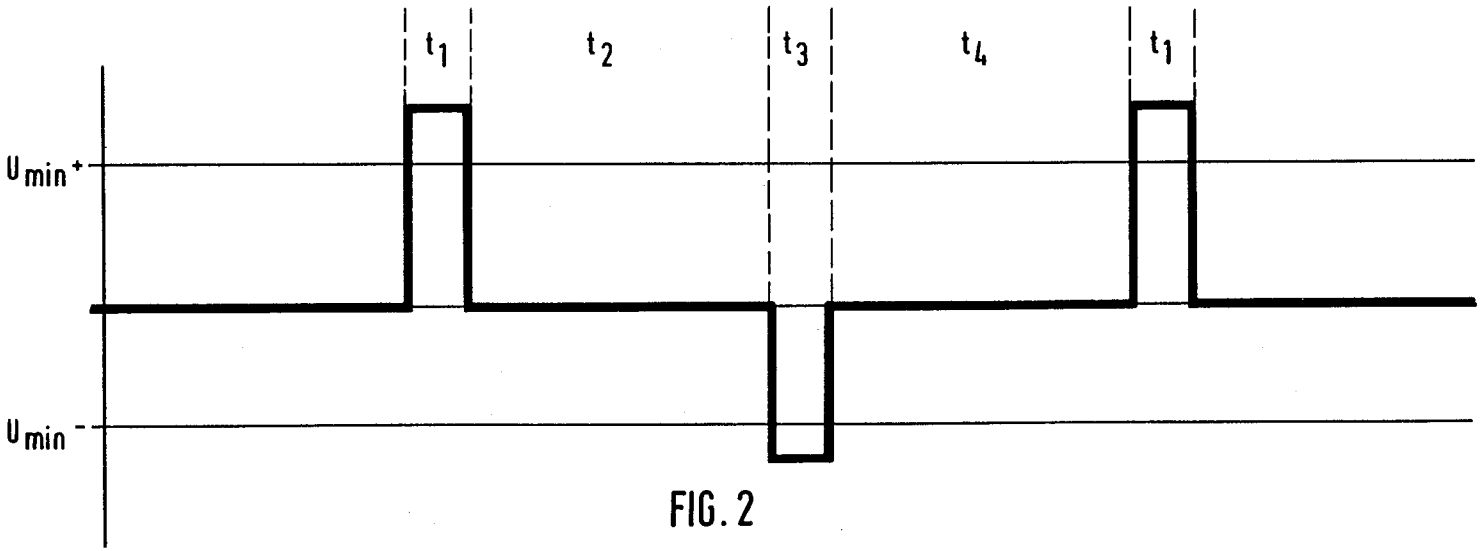
FIG. 2 the time behaviour of the high voltage for supplying the discharge electrodes according to the present invention.

The point discharge electrodes are controlled with a high voltage, according to FIG. 2, alternately with positive and negative pulses with steep edges. For example, initially the high voltage is applied over a time $t_1$, which is chosen in such a way that the space between electrodes 4,6 is filled with positive ions. During this time, as a result of the high ionic velocity due to the high field strengths, scarcely any ions are discharged into the air flow which is flowing at right angles to the grid-like electrode arrangement as in FIG. 5a. If, after a time which corresponds to the ion transit time, the high voltage is disconnected in steep edge manner, the force action of the electric field ceases and consequently the ions can be discharged through the frictional force of the air flow out of the space of greatest field strength between electrodes 4,5 and 6, which takes place during time $t_2$. The antipole, negative high voltage is then applied to the same point electrodes 6. The negative high voltage also only remains connected until a negative ion cloud fills the space between electrodes 4, 5, 6 ($t_3$) and is then disconnected in steep edged manner. The distance a according to FIG. 5a, between electrode supports 5, with discharge electrodes 6, and counterelectrodes 4, via the ion mobility, determines the connection time $t_1$ and $t_3$ of the high voltage. The connection times are, for example, between a few and a few dozen ms, particularly between 5 and 60 ms. In the case of air flows between 0.1 and 1 m/sec, the disconnection times, (i.e., the spacing of the rules) are between 100 and 1000 ms. This leads to pulse duty factors of 1:5 to 1:20. As a result of this interaction of the fixed electrode arrangement and the connection and disconnection of the high voltage, most of the ions generated at the points of the discharge electrodes are introduced into the air flow. As a result, current loading is reduced at the points by amounts responsible for the disadvantageous particle production in the air flow.

A low-erosion electrode material is used for the discharge electrodes, the prior art having used high-grade steel and tungsten, the latter being worn away less. Research carried out with other materials has revealed that much better results are obtained with niobium and its alloys as the electrode material, so that this material is used for discharge electrode 6. Table 1 shows the results of a test performed over 1000 hours with 20X, non pulsing current loading of the point discharge electrodes. Column 2 shows that the volume worn away is less by a factor of 6 compared with tungsten. Tantalum also gave better results than tungsten.

Figure 7A:
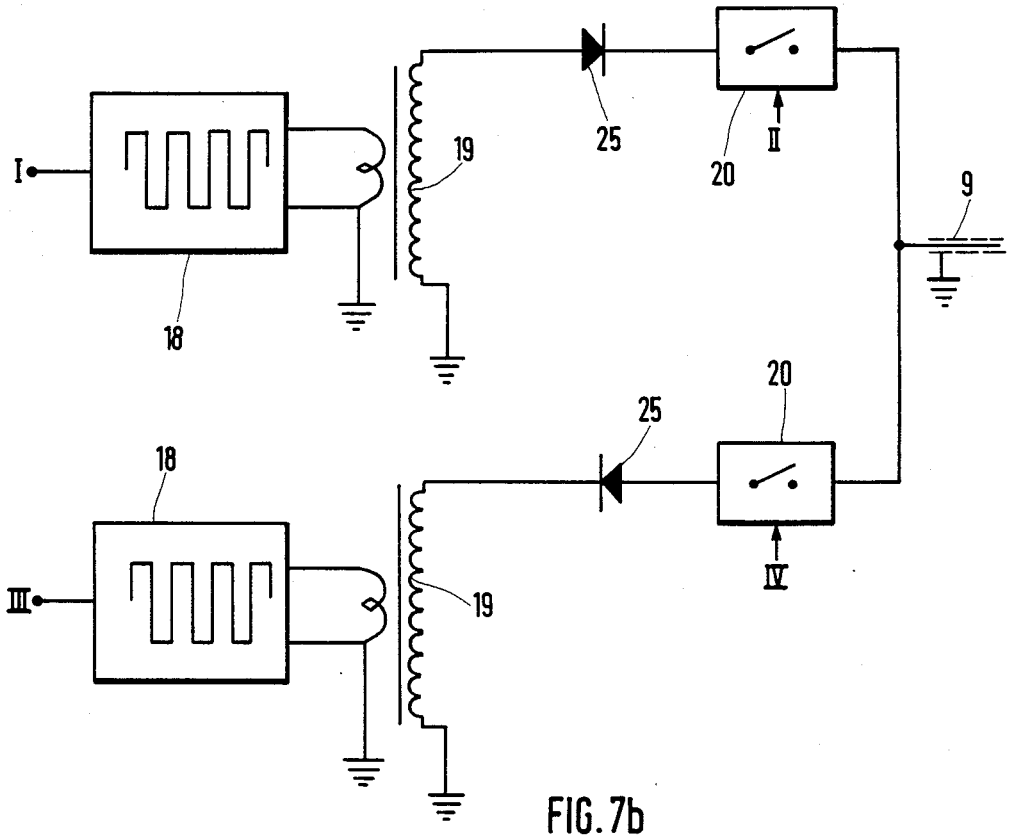
FIG. 7a the circuitry design of the high voltage module of the present invention.

The high velocity module 31, which is preferably positioned in the vicinity of the electrode arrangement for reducing the length of high voltage cable 9, but also outside the air flow, is shown in greater detail in FIG. 7a.

TABLE 1

TEST of needle

| test datas: | | calculation assumption: | |
|---|---|---|---|
| operation time | 1000 h | air speed | 0,3 $ms^{-1}$ |
| load | 20 - time normal load corresp. to 1a operation under normal load | number of needle | 100 $m^{-2}$ |
| | | airvolume per year and needle | 100.000 $m^3$ |
| evaluation | graphically | | |

| Material | material loss ($\mu m^3$) | particles with sizes 50 nm Ø | particles with sizes 100 nm Ø | particles concentration per $m^3$ 50 nm Ø | particles concentration per $m^3$ 100 nm Ø | particles concentration per $ft^3$ 50 nm Ø | particles concentration per $ft^3$ 100 nm |
|---|---|---|---|---|---|---|---|
| Wolfram (Th 2%) | 20,5 $10^3$ | 164 $10^6$ | 20,5 $10^6$ | 1640 | 205 | 47 | 6 |
| Titan | 29,0 $10^3$ | 232 $10^6$ | 29,0 $10^6$ | 2320 | 290 | 66 | 8 |
| Tantal | 11,7 $10^3$ | 93,6 $10^6$ | 11,7 $10^6$ | 1170 | 94 | 33 | 3 |
| Niob | 3,48 $10^3$ | 27,8 $10^6$ | 3,48 $10^6$ | 348 | 28 | 10 | <1 |

Figure 7B:
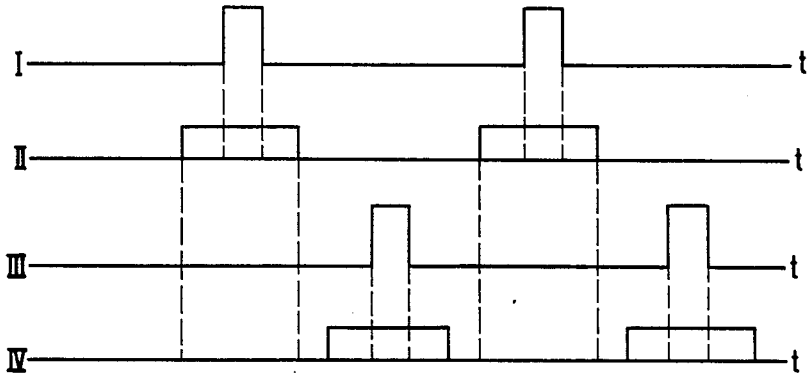

Two high voltage oscillators 18, by a means of drivers (not shown), energize with low voltage the primary winding of two high voltage transformers 19 and, as a function of the passage of the, in each case, concomitantly cast high voltage diodes, one transformer produces a positive high voltage and the other a negative high voltage. The high voltage relays 20 switch the high voltage on the shielded high voltage cable 9, which supplies the discharge electrodes 6. In order that the high voltage relays 20 switch in load-free manner, oscillators 18 and relays 20 are energized in accordance with the pulse diagram of FIG. 7*b*. The latter shows that the high voltage relays 20 are switched on or off, if the pulse-like energized oscillators 18 are not switched on.

The low voltage control unit 30 can be located in the immediate vicinity of the work station, or can be housed in a central switching cubicle. It supplies two direct currents with independently adjustable d.c. voltage values to the high voltage module, so that the positive and negative high voltage values can be determined independently of one another. For regulating the d.c. voltage values produced by the low voltage control unit 30 and therefore for regulating the balance of the ion polarity, the currents used for generating the positive and negative ions are separately measured in the high voltage module 31 and supplied as a controlled variable to the low voltage control unit 30, by a control loop (not shown).

The electrode arrangement according to FIG. 5*a* contains special counterelectrodes 4. FIGS. 5*b* and 5*c* show other configurations in which the counterelectrodes are formed by equipment components surrounding the discharge electrodes 6. For example, according to FIG. 5*b*, a frame system 16, which is electrically grounded, is constructed as the counterelectrode. In FIG. 5*c* the counterelectrode is constituted by a grounded perforated plate 17 and which can serve as a viewing diaphragm or the like.

Figure 3:
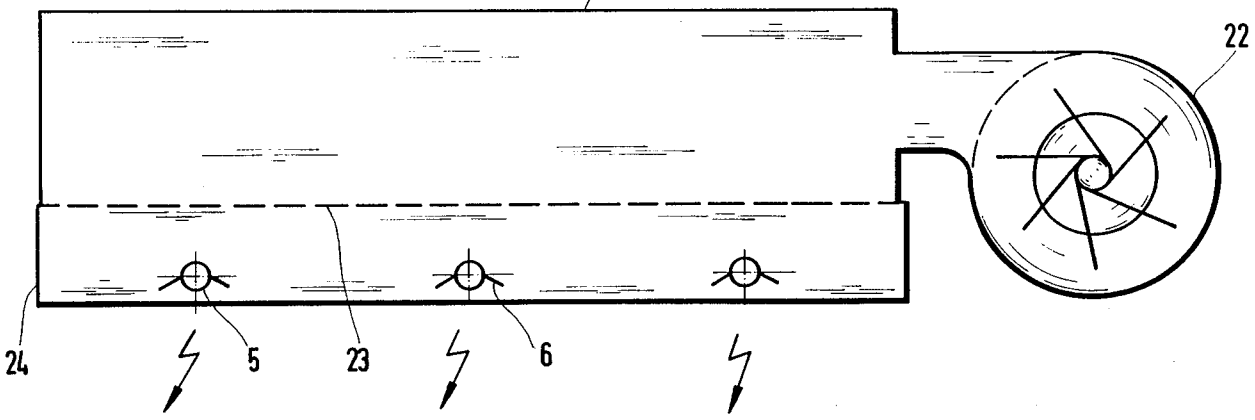
FIG. 3 is a section through a first embodiment of the present invention.

Another embodiment is shown in FIG. 3, in which, instead of dosing ions in a gas or air stream present in the room, a closed apparatus is provided which has a device for producing an equidirectional flow over a large cross-section. This device has a blower for fan 22, which supplies a pressure chamber 21 which, on the outflow side, is bounded by a uniformly air-permeable layer 23 constructed as a deflector. The deflector forms the counterelectrode for the point discharge electrodes 6, which are located below the deflector 23 and according to FIG. 5*a* are fixed to electrode supports 5. The equidirectional flow is stabilized by an all-round flow guard 24 in the surrounding room.

While one embodiment of the invention has been described in detail, it will be apparent to those skilled in the art that the disclosed embodiment is subject to modification. Therefore, the foregoing description is to be considered exemplary rather than limiting, and the true scope of the invention is that defined in the following claims.

We claim:

1. A device for generating ions in a gas stream with an electrode arrangement exposed to the gas stream and a pulsed high voltage supply, which supplies an alternating sequence of negative and positive pulses with steep edges, characterized in that the electrode arrangement has at least one point discharge electrode and at least one counterelectrode arranged in a fixed and clearly defined association with one another for the transit of ions therebetween and that the duration of the particular pulse corresponds to the transit time of the ions between the electrodes and the spacing of the pulses is adapted to the speed of the gas stream.

2. The device according to claim 1, characterized in that the pulse duration is approximately 5 to 60 ms and the spacing of the pulses in the case of a gas stream speed of approximately 0.1 to 1 m/s is approximately 100 to 1000 ms.

3. The device according to claim 1 characterized in that the electrode arrangement has rod-like, parallel counterelectrodes arranged in reciprocally alternating manner and electrode supports carrying point discharge electrodes, the discharge electrodes being arranged in one plane preferably at right angles to the counter electrodes.

4. The device according to claim 3, characterized in that the counterelectrodes and electrode supports are preferably circular and have a diameter of approximately 3 to 15 mm and a reciprocal spacing between 5 and 50 cm and that the point discharge electrodes are arranged with a uniform spacing of approximately 5 to 30 cm.

5. The device according to claim 3 characterized in that the electrode supports carrying the point disharge electrodes are detachably fixed in a plug connector.

6. The device according to claim 5, characterized in that the electrode supports can be locked in the plug connector.

7. The device according to claim 1 characterized in that the at least one counterelectrode is a component of other parts, such as frame structures or viewing diaphragms formed from perforated plates, which are at a clearly defined distance from the point discharge electrodes and are at a clearly defined potential.

8. The device according to claim 1 characterized in that the high voltage supply comprises a low voltage control unit, which supplies two direct currents with adjustable d.c. voltage values and a high voltage module spatially separated from the low voltage control unit and connected thereto, the high voltage module being positionable in the vicinity of the electrode arrangement.

9. The device according to claim 8, characterized in that the high voltage module is connected by means of a single-core high voltage line to the electrode arrangement.

10. The device according to claim 8 characterized in that the high voltage module has in each case one voltage converter with an oscillator, a transformer, a rectifier, and in each case one high voltage relay for generating positive and negative high voltage.

11. The device according to claim 10, characterized in that the particular high voltage relay is switched with the same timing as the energizing of the associated oscillators in load-free manner in the energizing pulse intervals.

12. The device according to claim 8, characterized in that for regulating the balance of the ion polarity, the currents required for generating the positive and negative ions are measured and serve as a controlled variable for setting the d.c. voltage values.

13. The device according to claim 1 characterized in that the point discharge electrodes are made from niobium or its alloys.

14. The device according to claim 1, characterized in that the gas flow is led over a pressure chamber which is closed by a deflector, perforated plate, or the like and that the discharge electrodes are arranged on the outflow side of the perforated plate, the latter forming the counterelectrode.

* * * * *